US011285630B2

(12) United States Patent
Lu et al.

(10) Patent No.: US 11,285,630 B2
(45) Date of Patent: Mar. 29, 2022

(54) HANDLE FOR A RAZOR

(71) Applicant: The Gillette Company, Boston, MA (US)

(72) Inventors: Hong Lu, Newton, MA (US); Stephen Charles Witkus, Northbridge, MA (US); Alexander Stephen Forti, Dedham, MA (US); Huibin Gong, Shenzhen (CN)

(73) Assignee: The Gillette Company LLC, Boston, MA (US)

( * ) Notice: Subject to any disclaimer, the term of this patent is extended or adjusted under 35 U.S.C. 154(b) by 775 days.

(21) Appl. No.: 15/235,019

(22) Filed: Aug. 11, 2016

(65) Prior Publication Data

US 2018/0043554 A1 Feb. 15, 2018

(51) Int. Cl.
*B26B 21/52* (2006.01)
*B26B 21/22* (2006.01)

(52) U.S. Cl.
CPC ..... *B26B 21/521* (2013.01); *B26B 21/222* (2013.01); *B26B 21/52* (2013.01); *B26B 21/522* (2013.01)

(58) Field of Classification Search
CPC ..... B26B 21/52; B26B 21/521; B26B 21/522; B26B 21/5225; B26B 21/528; B26B 21/225; B26B 5/006; Y10T 16/476
USPC ..... 16/430
See application file for complete search history.

(56) References Cited

U.S. PATENT DOCUMENTS 1,104,563 A * 7/1914 Smith ..... B26B 29/025 30/151
1,584,319 A * 5/1926 Oki ..... B44D 3/164 30/339
1,617,563 A * 2/1927 Baum ..... B26B 5/006 30/321
1,710,113 A * 4/1929 Rothermel ..... B44D 3/162 30/142
3,770,950 A 11/1973 Brenneman et al.
4,837,892 A * 6/1989 Lo ..... B25F 5/006 16/431
4,949,457 A * 8/1990 Burout, III ..... B25G 1/10 16/110.1

(Continued)

OTHER PUBLICATIONS

U.S. Appl. No. 15/234,986, filed Aug. 11, 2016, Hong Lu et al.

(Continued)

*Primary Examiner* — Ghassem Alie
*Assistant Examiner* — Samuel A Davies
(74) *Attorney, Agent, or Firm* — Joanne N. Pappas; Kevin C. Johnson

(57) ABSTRACT

A razor handle for a razor cartridge is provided. The handle comprises a head, a body, a cover layer, and a clip member. The head has a cartridge engaging end and an attachment end. The body has a front end and a rear end and comprises a first shell and a second shell that are releasably coupled together. The front end is coupled with the attachment end. The cover layer at least partially surrounds the body. The clip member is coupled with the first shell and the second shell at the rear end of the body such that the first and second shells are held together at least partially by the clip member. The clip member has a plurality of features which are coupled to a plurality of features on the body. These are retention features such as recesses or projections.

16 Claims, 11 Drawing Sheets

(56) References Cited

U.S. PATENT DOCUMENTS

| | | | | |
|---|---|---|---|---|
| 5,027,511 | A * | 7/1991 | Miller | B26B 21/522 16/430 |
| 5,107,590 | A | 4/1992 | Burout, III et al. | |
| 5,497,551 | A | 3/1996 | Apprille, Jr. | |
| 6,273,626 | B1 | 8/2001 | Yazawa | |
| 6,595,900 | B1 * | 7/2003 | Cook | A63B 5/20 482/126 |
| 6,610,382 | B1 | 8/2003 | Kobe et al. | |
| 6,880,253 | B1 | 4/2005 | Gyllerstrom | |
| 7,047,591 | B2 | 5/2006 | Hohlbein | |
| 7,383,619 | B2 | 6/2008 | Gross et al. | |
| 7,685,720 | B2 | 3/2010 | Efthimiadis et al. | |
| 8,151,468 | B2 | 4/2012 | Schulz | |
| 8,205,341 | B2 * | 6/2012 | Rosso | B25G 3/26 30/169 |
| 8,507,061 | B2 | 8/2013 | Quigley et al. | |
| 2004/0216311 | A1 * | 11/2004 | Follo | B26B 21/522 30/526 |
| 2006/0052535 | A1 | 3/2006 | Ajbani et al. | |
| 2006/0242847 | A1 | 11/2006 | Dansreau et al. | |
| 2006/0272154 | A1 | 12/2006 | Brevard | |
| 2009/0293292 | A1 | 12/2009 | Ramm et al. | |
| 2011/0030229 | A1 | 2/2011 | Psimadas et al. | |
| 2011/0035950 | A1 | 2/2011 | Royle | |
| 2011/0061249 | A1 * | 3/2011 | Ma | A01G 3/02 30/520 |
| 2012/0167401 | A1 | 7/2012 | Quigley et al. | |
| 2012/0168439 | A1 | 7/2012 | Quigley et al. | |
| 2013/0291390 | A1 | 11/2013 | Gajria et al. | |
| 2016/0288346 | A1 * | 10/2016 | Anderson | B26B 5/006 |

OTHER PUBLICATIONS

U.S. Appl. No. 15/235,006, filed Aug. 11, 2016, Hong Lu et al.
U.S. Appl. No. 15/234,998, filed Aug. 11, 2016, Hong Lu et al.
U.S. Appl. No. 15/235,014, filed Aug. 11, 2016, Hong Lu et al.
U.S. Appl. No. 15/235,026, filed Aug. 11, 2016, Hong Lu et al.
U.S. Appl. No. 15/235,033, filed Aug. 11, 2016, Hong Lu et al.
U.S. Appl. No. 15/235,044, filed Aug. 11, 2016, Hong Lu et al.
U.S. Appl. No. 15/235,049, filed Aug. 11, 2016, Hong Lu et al.
U.S. Appl. No. 15/235,056, filed Aug. 11, 2016, Hong Lu et al.
U.S. Appl. No. 15/235,059, filed Aug. 11, 2016, Hong Lu et al.

* cited by examiner

HANDLE FOR A RAZOR

FIELD OF INVENTION

The systems described below generally relate to a handle for a razor.

BACKGROUND OF THE INVENTION

Razor handles are provided for attachment to a razor cartridge.

SUMMARY OF THE INVENTION

In accordance with still yet another embodiment, a handle for a razor cartridge is provided. The handle comprises a head, a body, a cover layer, and a clip member. The head has a cartridge engaging end and an attachment end. The body has a front end and a rear end and comprises a first shell and a second shell that are releasably coupled together. The front end is coupled with the attachment end. The cover layer at least partially surrounds the body. The clip member is coupled with the first shell and the second shell at the rear end of the body such that the first and second shells are held together at least partially by the clip member.

BRIEF DESCRIPTION OF THE DRAWINGS

It is believed that certain embodiments will be better understood from the following description taken in conjunction with the accompanying drawings in which.

DETAILED DESCRIPTION OF THE INVENTION

Figure 1:
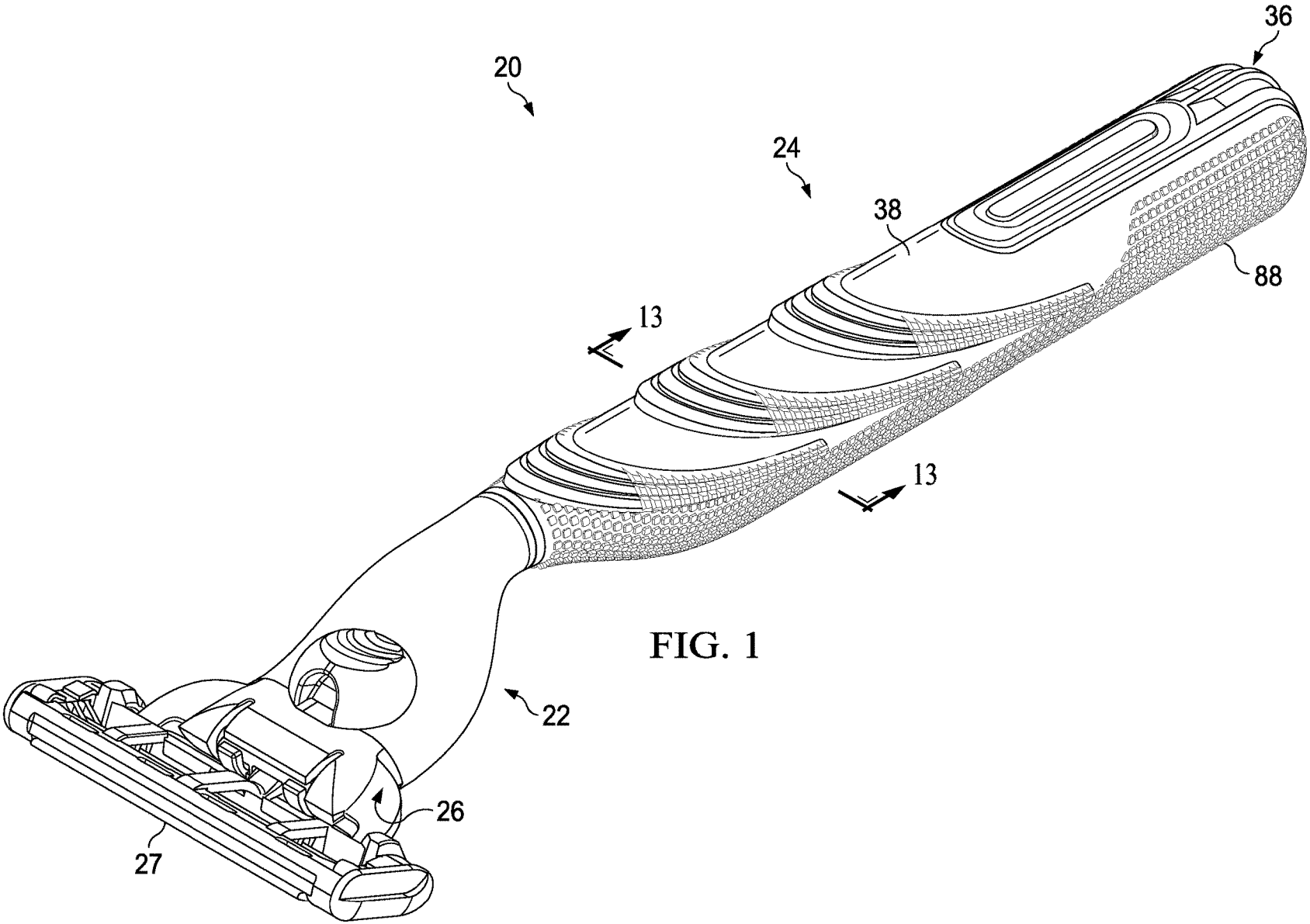
FIG. 1 is an isometric view depicting a handle for a razor cartridge.

In connection with the views and examples of FIGS. 1-14, wherein like numbers indicate the same or corresponding elements throughout the views, a handle 20 for a razor cartridge is shown in FIG. 1 to include a head 22 and a base portion 24 that can be grasped by a hand of a user to manipulate the head 22. The head 22 can include a cartridge engaging end 26 that is configured to facilitate coupling of the handle 20 to a razor cartridge 27. In one embodiment, as illustrated in FIG. 1, the cartridge engaging end 26 can be configured to receive (e.g., releasably couple to and interact with or be permanently attached to, in the case of a fully disposable type razor) a GILLETTE MACH3® cartridge. However, in other embodiments, the cartridge engaging end 26 can be configured to receive a variety of other suitable cartridges which may include other GILLETTE® type cartridges, such as the GILLETTE FUSION RAZOR®. For another example, a cartridge engaging end can be configured to receive a razor cartridge that is compatible with a DORCO® docking interface, an example of which is disclosed in U.S. Pat. No. 8,590,162, which is hereby incorporated by reference in its entirety. In another example, a cartridge engaging end can be configured to receive a razor cartridge that is compatible with the AMERICAN SAFETY RAZOR® (ASR) docking interface an example of which is disclosed in U.S. Pat. No. 8,079,147, which is hereby incorporated by reference in its entirety. In yet another example, a cartridge engaging end can be configured to receive a razor cartridge that is compatible with the HARRY'S RAZOR® cartridge docking interface.

Figure 2:
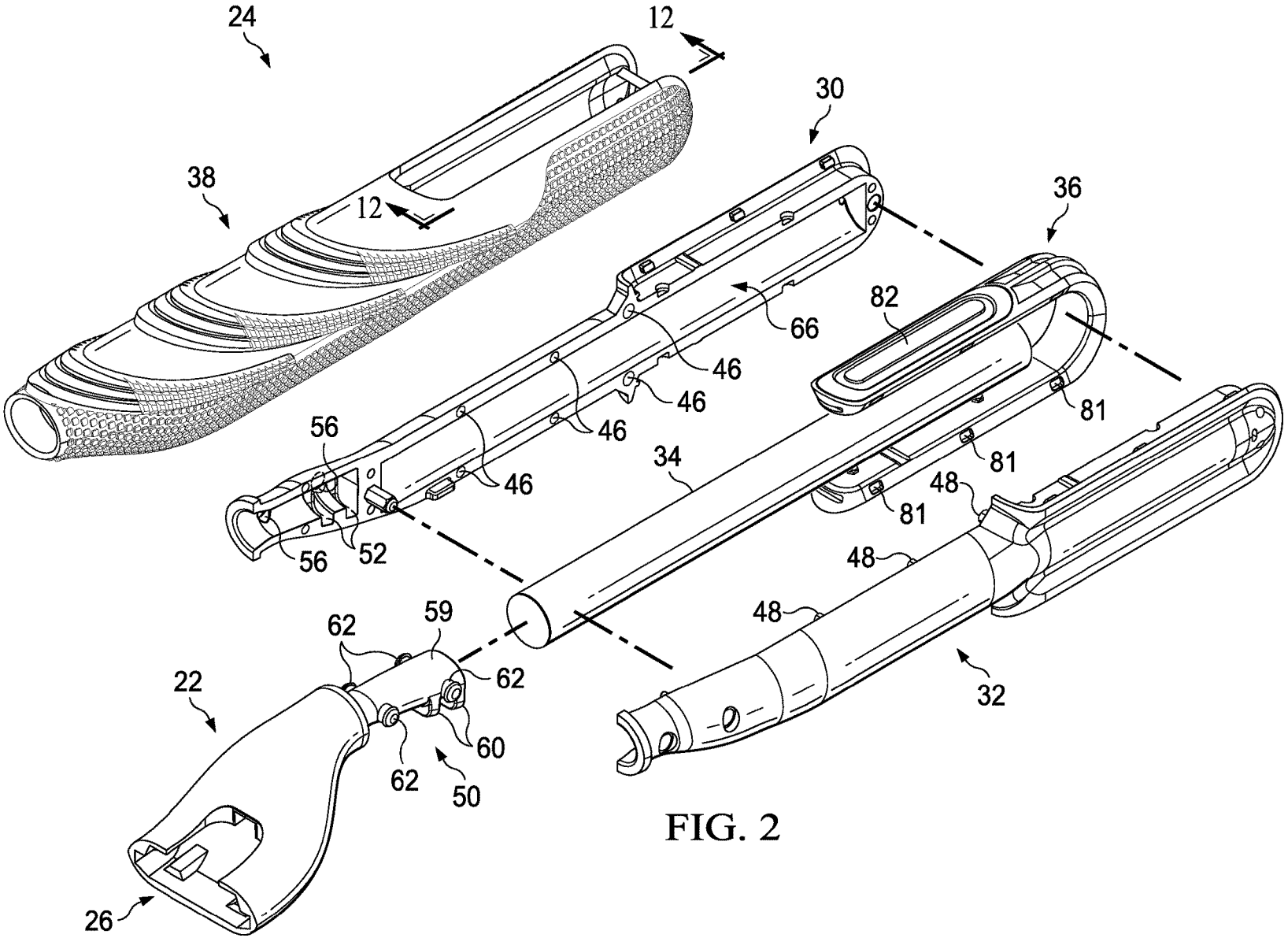
FIG. 2 is an exploded isometric view depicting the handle of FIG. 1.
Figure 3:
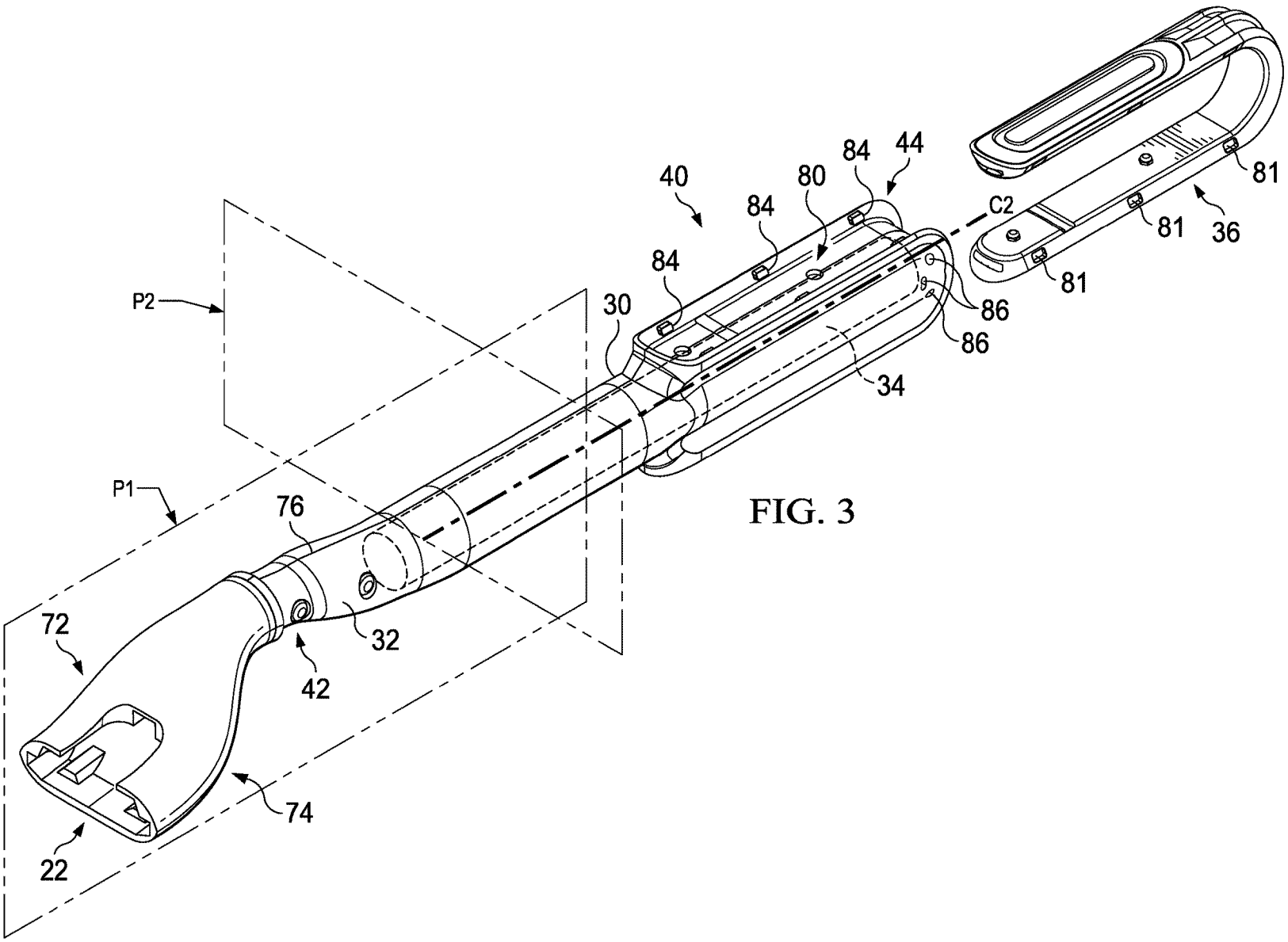
FIG. 3 is an isometric view depicting the handle of FIG. 1 with certain components removed and other components shown in exploded view for clarity of illustration.
Figure 4:
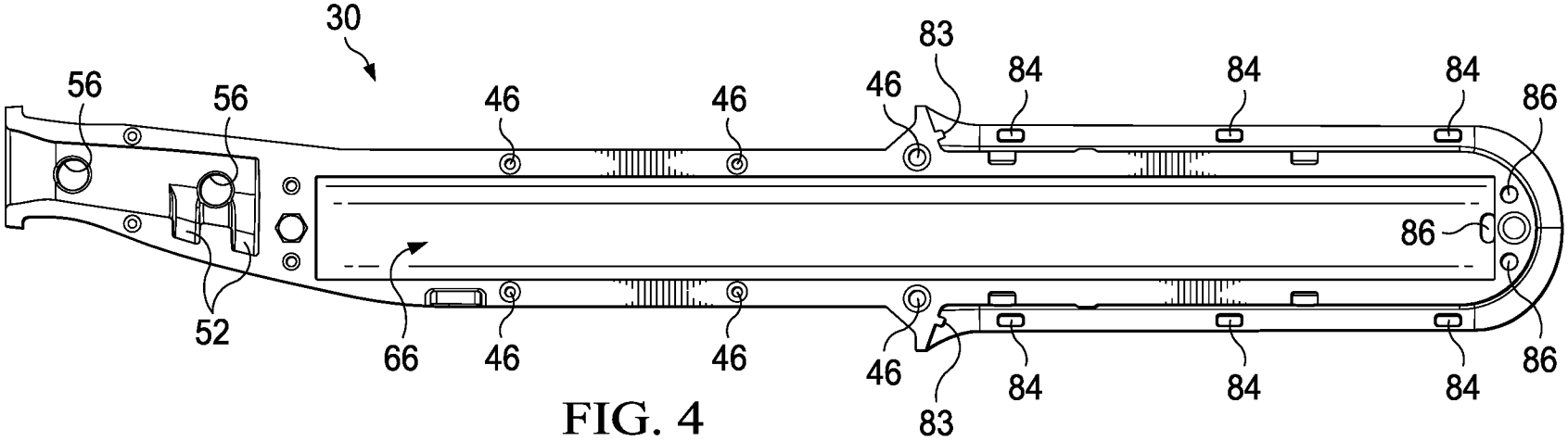
FIG. 4 is a side view depicting a right shell of the handle of FIG. 1.
Figure 5:
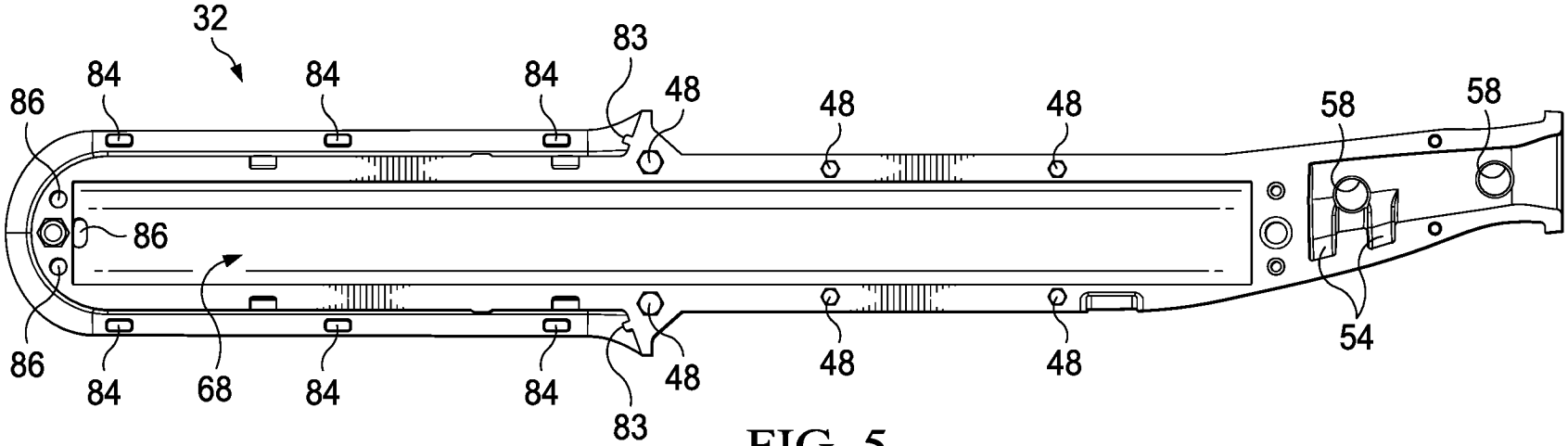
FIG. 5 is a side view depicting a left shell of the handle of FIG. 1.

Referring now to FIGS. 2 and 3, the base portion 24 can comprise a right shell 30, a left shell 32, a rod 34, a clip member 36, and a cover layer 38. As illustrated in FIG. 3, the right shell 30 and the left shell 32 can be releasably coupled together to form a body 40 that has a front end 42 and a rear end 44. In one embodiment, as illustrated in FIGS. 4 and 5, the right shell 30 can define a plurality of holes 46 (FIG. 4) and the left shell 32 can include a plurality of posts 48 (FIG. 5) that can each be inserted into one of the holes 46 to facilitate releasable coupling of the right and left shells 30, 32 together. It is to be appreciated that the right and left shells 30, 32 can be releasably coupled with each other in any of a variety of suitable alternative manners (e.g., a shell can include both holes and posts). It is also to be appreciated that, although the body 40 is shown to be separated into right and left shells 30, 32, a body can be provided in any of a variety of arrangements including, for example, a unitary one-piece construction.

As shown in FIGS. 2 and 3, an attachment end 50 of the head 22 can be coupled with the front end 42 of the body 40. The body 40 and the attachment end 50 can include various features that are configured to facilitate coupling of the front end 42 of the body 40 with the attachment end 50. In one embodiment, as illustrated in FIGS. 4 and 5, the right shell 30 and left shell 32 can each include respective pairs of slots 52, 54, each disposed at the front end 42 of the body 40 (see FIG. 3). When the right and left shells 30, 32 are coupled together, each of the slots 52 of the right shell 30 can correspond with one of the slots 54 of the left shell 32. The right shell 30 and left shell 32 can also include respective pairs of through holes 56, 58. For each of the right and left shells 30, 32, one of the through holes (e.g., 56 and 58, respectively) is shown to be disposed between the slots (e.g., 52 and 54, respectively) and the other of the through holes (e.g., 56 and 58, respectively) is shown to be disposed rearwardly of the slots (e.g., 52 and 54, respectively).

Figure 6:
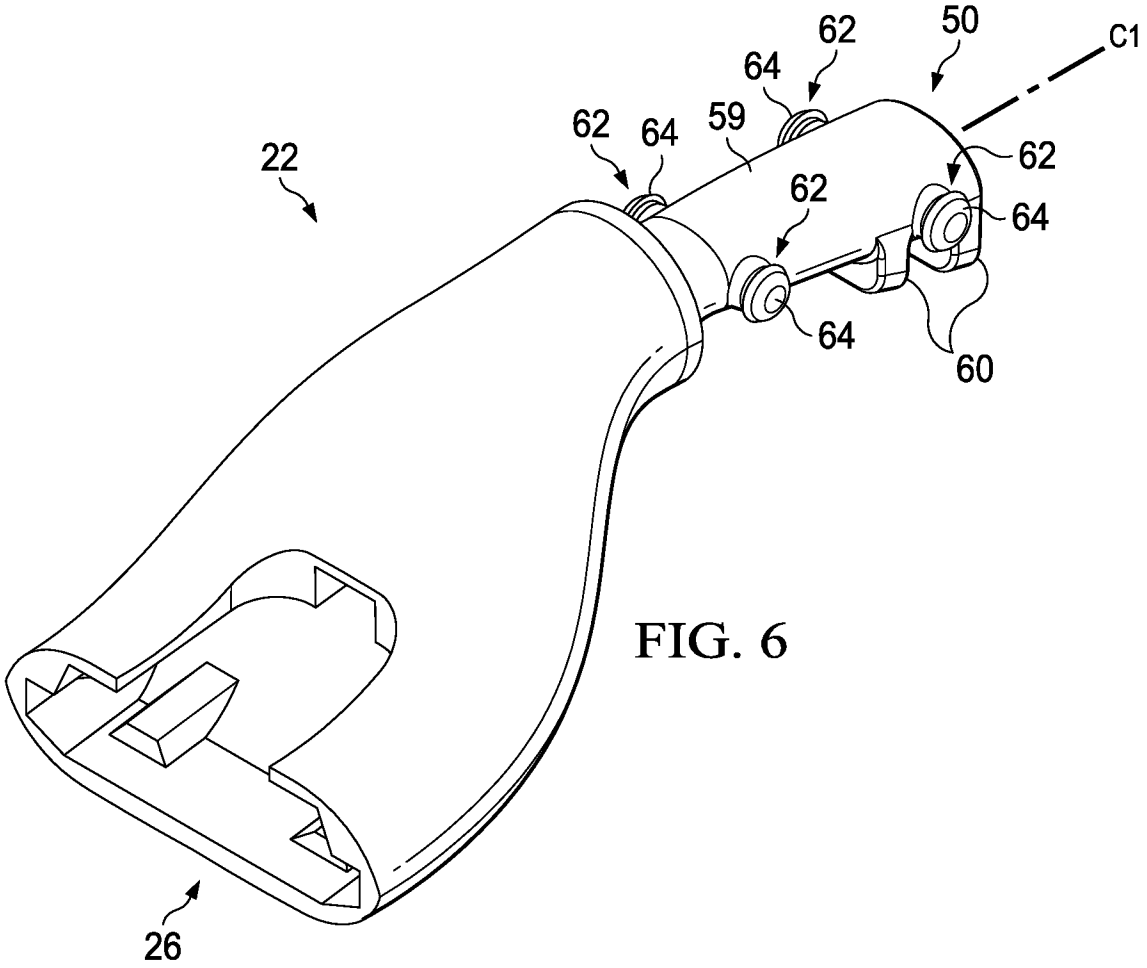
FIG. 6 is an isometric view depicting a head of the handle of FIG. 1.
Figure 7:
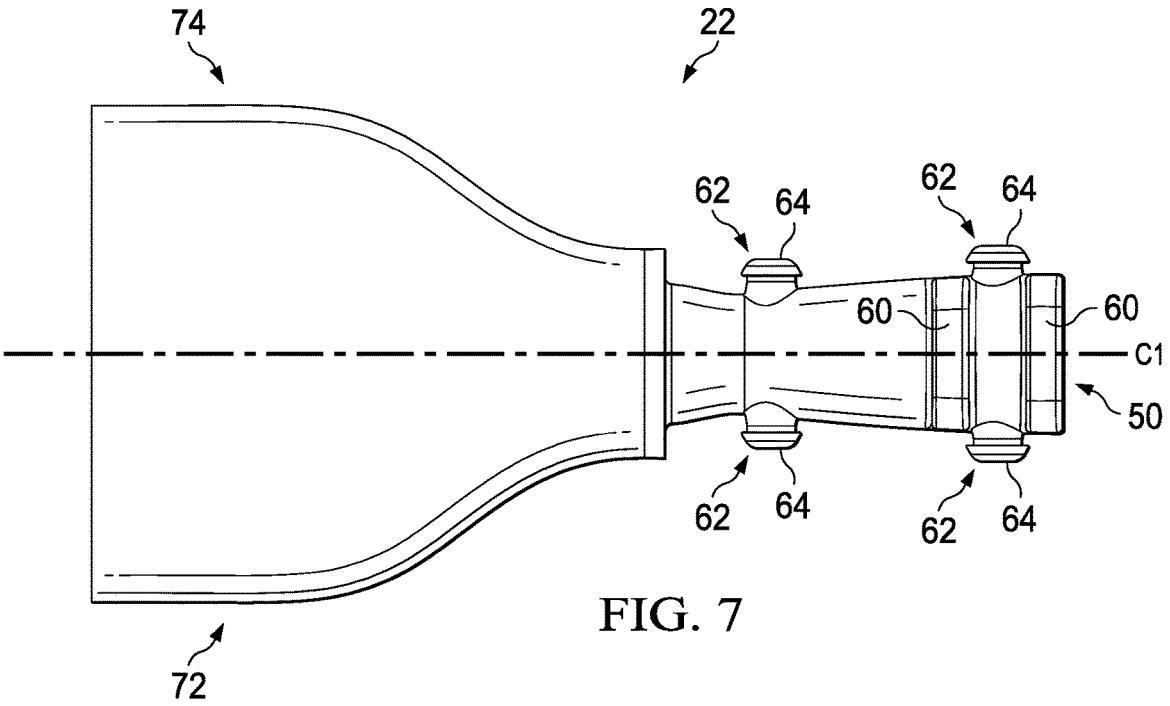
FIG. 7 is a bottom view of the head of FIG. 6.
Figure 8:
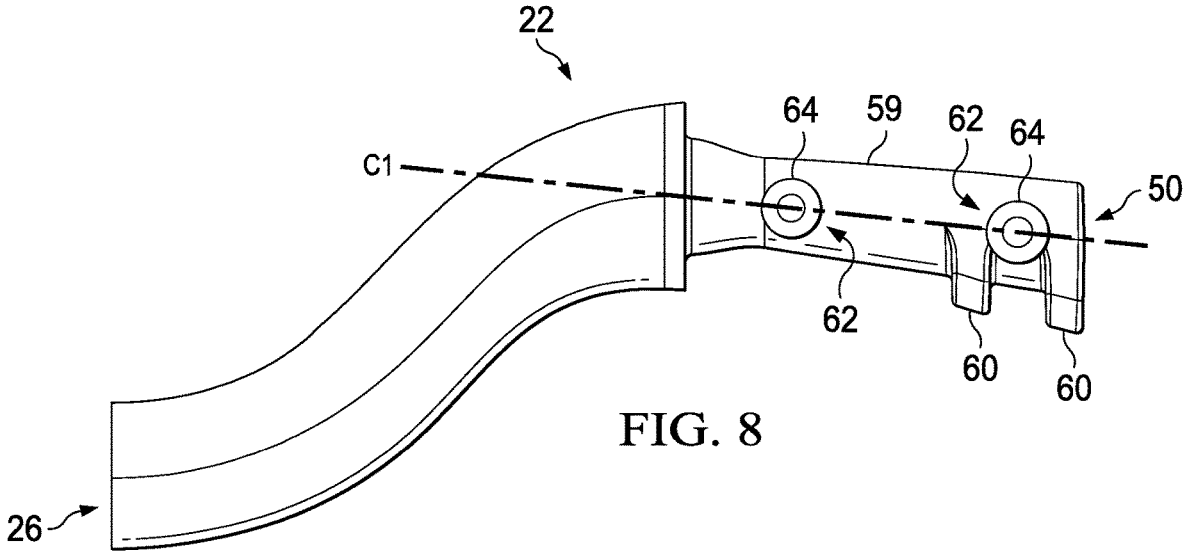
FIG. 8 is a side view of the head of FIG. 6.

Referring now to FIGS. 6-8, the attachment end 50 can comprise a stem 59, a pair of protrusions 60, and pairs of posts 62. Each of the protrusions 60 and posts 62 are shown to extend away from a centerline C1 defined by the stem 59 in a substantially perpendicular direction from the centerline C1. The protrusions 60 can extend away from the centerline C1 in the same direction. The posts 62 can extend away from the centerline C1 in substantially opposite directions and substantially perpendicularly to the direction of the protrusions 60. Each of the protrusions 60 can correspond with one of the slots 52, 54 defined by each of the right shell 30 and the left shell 32. Each of the posts 62 can correspond with one of the through holes 56, 58 defined by each of the right shell 30 and the left shell 32. It is to be appreciated that the head 22 and/or body 40 can be provided with any quantity and configuration of protrusion and slots that interact with one another and/or posts and through holes that interact with one another to facilitate coupling of the head 22 with the body 40.

When the right and left shells 30, 32 are coupled together with the attachment end 50 disposed therebetween, each of the protrusions 60 can extend into one of the slots 52, 54 and each of the posts 62 can extend into one of the through holes 56, 58. In one embodiment, the protrusions 60 can be substantially square shaped such that when the right and left shells 30, 32 are coupled together, the protrusions 60 can fit within the slots 52, 54 and the square shape can prevent rotation of the stem 59 with respect to the body 40.

In one embodiment, as illustrated in FIGS. 6-8, the posts 62 can each include an enlarged portion 64 at a distal end. The enlarged portions 64 can have a larger diameter than the through holes 56, 58. During assembly, the right and left shells 30, 32 can be installed over the attachment end 50 and compressed together with enough force to push the enlarged portions 64 through the respective through holes 56, 58 and to an exterior of the body 40. The through holes 56, 58 and/or the enlarged portions 64 can be deformed as a result which can resiliently and releasably couple the right and left shells 30, 32 together and to the attachment end 50. It is to be appreciated that coupling the right and left shells 30, 32 together and to the attachment end 50 in this manner can reinforce the interaction between the body 40 and the attachment end 50 such that the head 22 is less likely to separate from the body 40 when the handle 20 is mishandled (e.g., dropped) than in conventional arrangements.

It is to be appreciated that each of the head 22 the right shell 30 and the left shell 32 can be formed of any of a variety of materials that are rigid enough to facilitate shaving with the handle 20, including, for example, acrylonitrile butadiene styrene (ABS). It is also to be appreciated that any of the head 22, the right shell 30, and the left shell 32 can be formed of the same or different materials.

Figure 13:
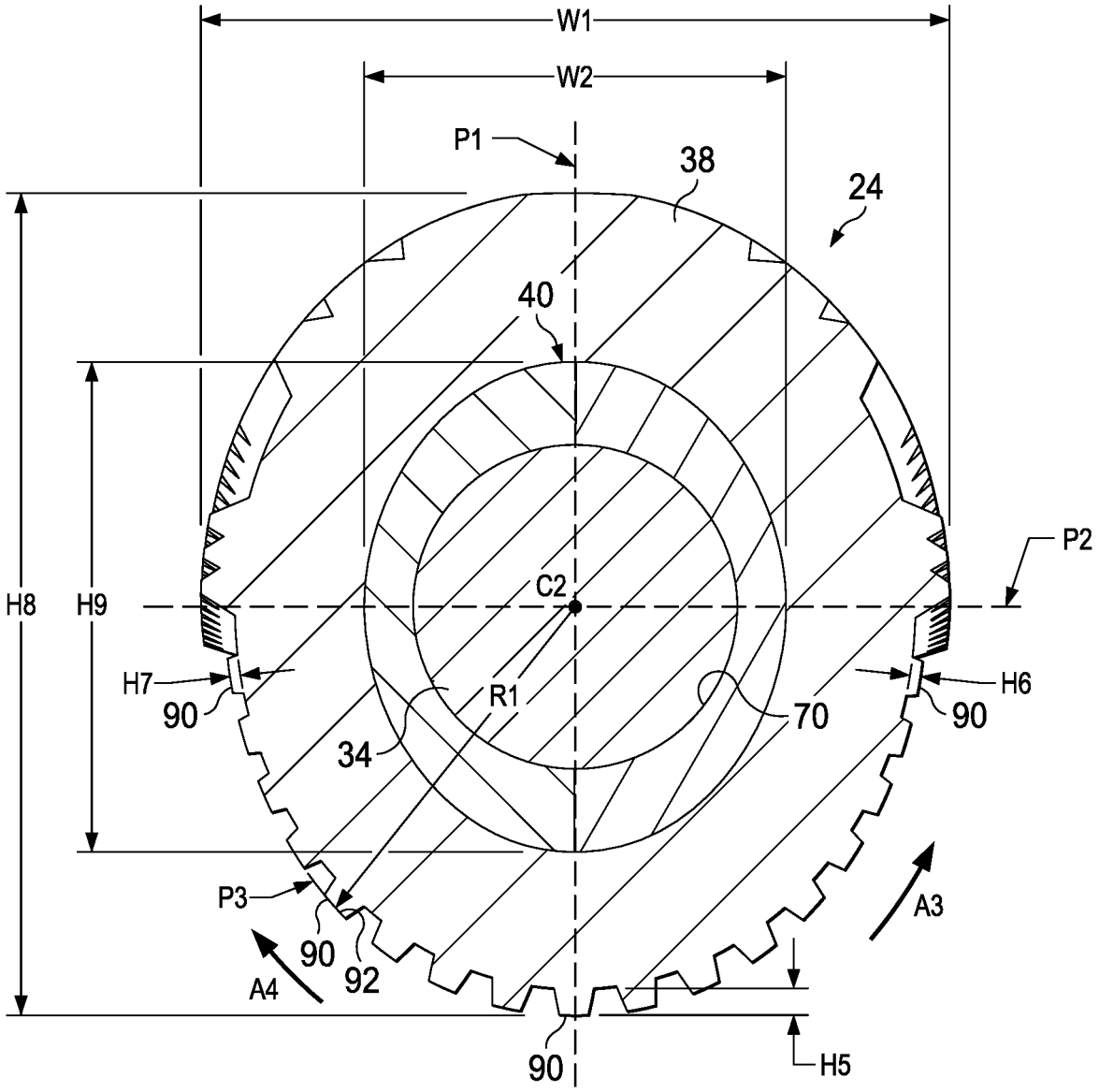
FIG. 13 is a cross sectional view taken along the line 13-13 of FIG. 1.

Referring again to FIGS. 4 and 5, the right shell 30 and the left shell 32 can each define respective right and left compartments 66, 68. When the right and left shells 30, 32 are coupled together, the right and left compartments 66, 68 can cooperate to define a hollow interior 70 (FIG. 13). The rod 34 can be disposed within the hollow interior 70. In some embodiments, the rod 34 and the right and left compartments 66, 68 can interact with each other to prevent movement of the rod 34 inside of the hollow interior 70. The rod 34 can be configured to provide some linear rigidity to the base portion 24 and can be weighted to enhance the overall feel and balance to the handle 20 when the base portion 24 is grasped by a user. In one embodiment, the rod 34 can be formed of a metal, such as, for example, stainless steel, steel, or aluminum. In another embodiment, the rod 34 can be formed of a high density thermoplastic.

Referring now to FIG. 3, the rod 34 (and the body 40) can define a centerline C2 that is substantially coaxial with the rod 34. The rod 34 can be spaced from the attachment end 50 along the centerline C2, such that a portion of the right and left shells 30, 32 are disposed therebetween. This spacing can allow the head 22 to flex somewhat relative to the rod 34, thereby alleviating some of the adverse effects that the rigidity of the rod 34 might otherwise have on the ability of the head 22 to resist separation of the head 22 from the body 40.

The centerline C2 can reside in an imaginary plane P1 that bisects the head 22 into right and left portions 72, 74 that are substantial mirror images of each other. A second imaginary plane P2 can be perpendicular to the first imaginary plane P1 and the centerline C2 can reside in the intersection between the first and second imaginary planes P1, P2. The right shell 30 and the left shell 32 can cooperate to form a seam 76 that is substantially parallel with the centerline C2 and that resides substantially within the first imaginary plane P1 such that the right and left shells 30, 32 are disposed on right and left sides of the handle 20.

Still referring to FIG. 3, the clip member 36 can be releasably coupled with the rear end 44 of the body 40. The clip member 36 can be substantially U-shaped and can include a pair of arm members 78 (FIG. 9) that are each substantially the same length. The right and left shells 30, 32 can cooperate to define a channel 80 at the rear end 44 of the body 40 that is substantially the same shape as the clip member 36 (e.g., U-shaped). The clip member 36 can be disposed in the channel 80 such that the arm members 78 overlie a portion of the seam 76.

Figure 9:
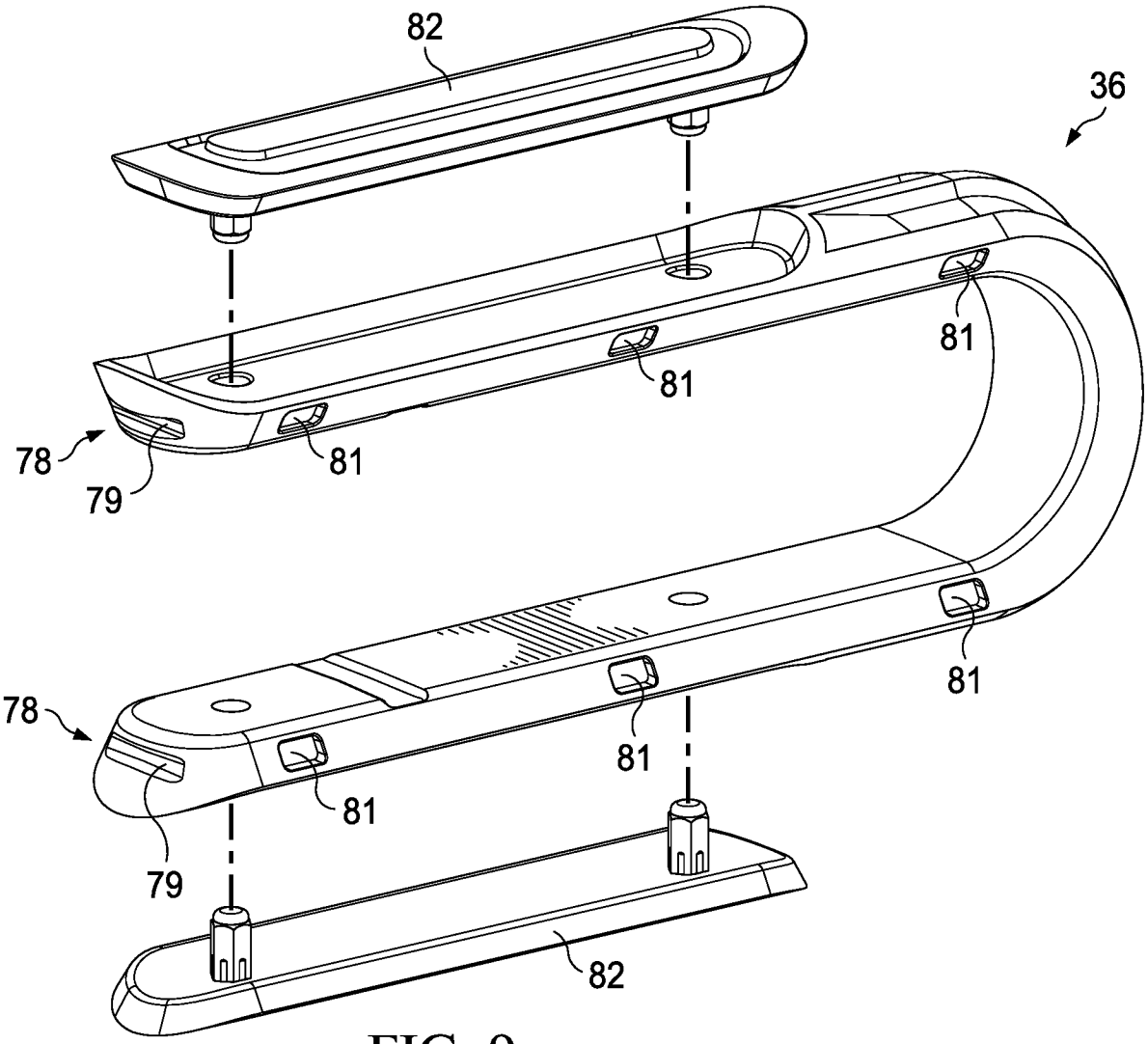
FIG. 9 is an isometric exploded view depicting a clip member of the handle of FIG. 1.
Figure 10:
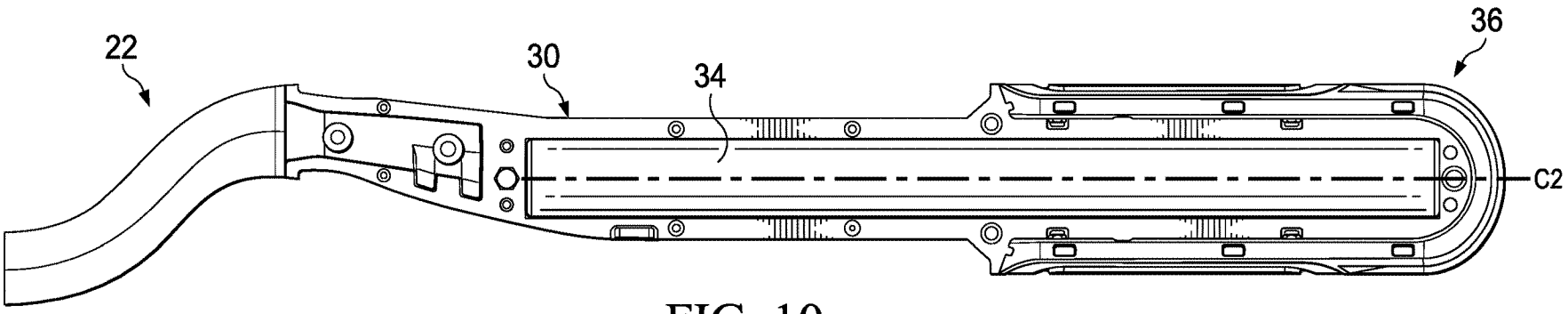
FIG. 10 is a side view depicting the handle of FIG. 1 with certain components removed for clarity of illustration.

Referring now to FIG. 9, the arm members 78 can include a plurality of recesses (e.g., 79 and 81). As illustrated in FIGS. 4 and 5, the right and left shells 30, 32 can include a plurality of projections 83 and 84. When the clip member 36 is disposed within the channel 80, the recesses 79 and 81 and the projections 83 and 84, respectively, can interact to facilitate coupling or retention of the clip member 36 to the right and left shells 30, 32 as well as releasable coupling of the right and left shells 30, 32 together. As illustrated in FIG. 9, the clip member 36 can include a pair of plates 82 that are releasably secured to the arm members 78. In one embodiment, the pair of plates 82 can be provided with product information (e.g., a logo or other marking) that identifies the razor or the handle 20. Referring now to FIG. 10, in one embodiment, with the clip member 36 coupled with the rear end 44 of the body 40, the clip member 36 can be spaced from the rod 34 (e.g., along each of the centerline C2, the first imaginary plane P1 (FIG. 3), and the second imaginary plane P2 (FIG. 3).

Referring now to FIGS. 3 and 13, the cover layer 38 can be substantially hollow and can at least partially surround the body 40 between the front end 42 and the rear end 44. The cover layer 38 is shown to entirely surround the body 40 between the front end 42 and the channel 80. When a user grasps the handle 20, the portion of the cover layer 38 entirely surrounding the body 40 can contact the user's hand to enhance the user's grip on the handle 20. A portion of the cover layer 38 that is disposed at the rear end 44 of the body 40 can extend up to, but not into, the channel 80 and can be routed around the channel 80 to enhance the overall aesthetics of the rear end 44 of the body 40 when the clip member 36 is installed. The cover layer 38 accordingly does not interfere with installation of the clip member 36 into the channel 80.

The cover layer 38 can be formed of any of a variety of suitable materials and can be overmolded, or otherwise applied, to the body 40 in such a manner that the cover layer 38 is formed to the body 40. In one embodiment, the cover layer 38 can be comprised of an SEBS-based thermoplastic elastomer (TPE) that has a hardness of about 15-20 Shore A and is configured to adhere to ABS plastic. The TPE can encourage a user's gripping of the base portion 24 more effectively than other conventional razor handle arrangements. In some embodiments, the TPE can be configured to have substantially the same coefficient of friction when dry and when exposed to water.

In one embodiment, as illustrated in FIGS. 3-5, the right and left shells 30, 32 can each comprise a pair of through holes 86 at base portion 24. When the cover layer 38 is applied to the body 40, the material of the cover layer 38 can extend into (e.g., creep), and in some embodiments extend through, the through holes 86 to facilitate securement of the cover layer 38 to the rear end 44 of the body 40. The front end 42 of the body 40 is shown to be narrower at the through holes 56, 58 than the rest of the body 40 (e.g., towards the rear end 44). As such, the cover layer 38 can be narrower at the front end 42 which can effectively secure the cover layer 38 to the front end 42 of the body 40. In one embodiment, the cover layer 38 can have a maximum thickness of between about 2.75 mm and 3.5 mm, although any of a variety of thicknesses are contemplated. It is to be appreciated that any quantity and configuration of through holes can be provided along the body 40 (i.e., at or between the front and rear ends 42, 44) through which the cover layer 38 can extend.

Figure 11:
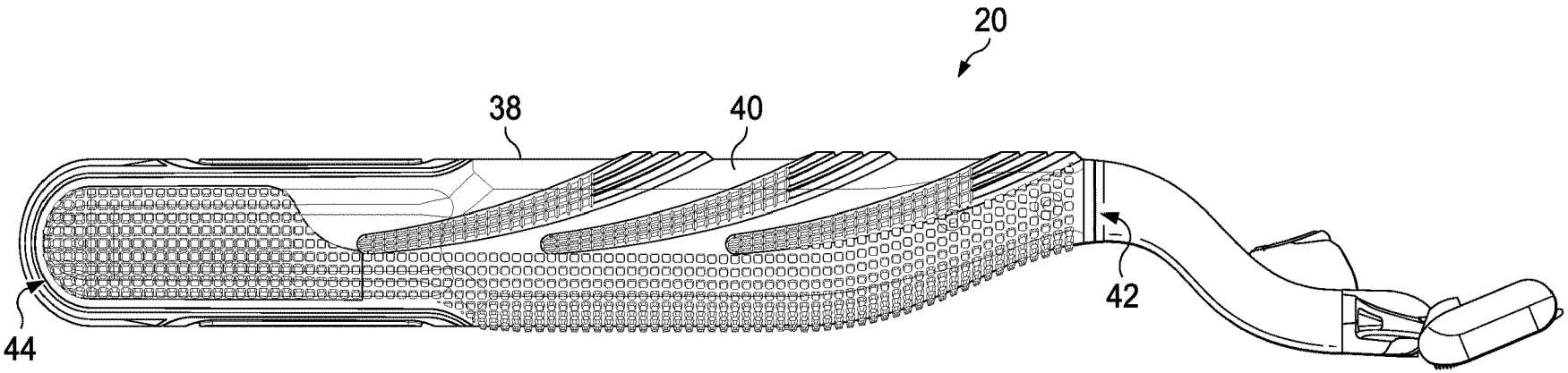
FIG. 11 is a side view depicting the handle of FIG. 1.

In one embodiment, as illustrated in FIG. 11, the cover layer 38 can be formed of a material (e.g., the TPE described above) that is substantially translucent. The cover layer 38 can be less opaque than the body 40 such that the body can be viewed through the cover layer 38. The body 40 can accordingly be provided with indicia (e.g., a product name, logo, or other markings) that can be visible through the cover layer 38. In some embodiments, the cover layer 38 can be tinted to provide an aesthetically pleasing color to the cover layer 38 while maintaining its translucence. It is to be appreciated that the cover layer 38 can comprise any of a variety of suitable additional or alternative materials. Some examples of suitable materials are described in U.S. Patent Application Publication Nos. 2007/0143942; 2009/0035524; 2009/0039688; 2009/0142551; 2011/0233973; and 2011/0256353 and U.S. Pat. No. 7,827,704, which are hereby incorporated by reference in their entirety.

Figure 12:
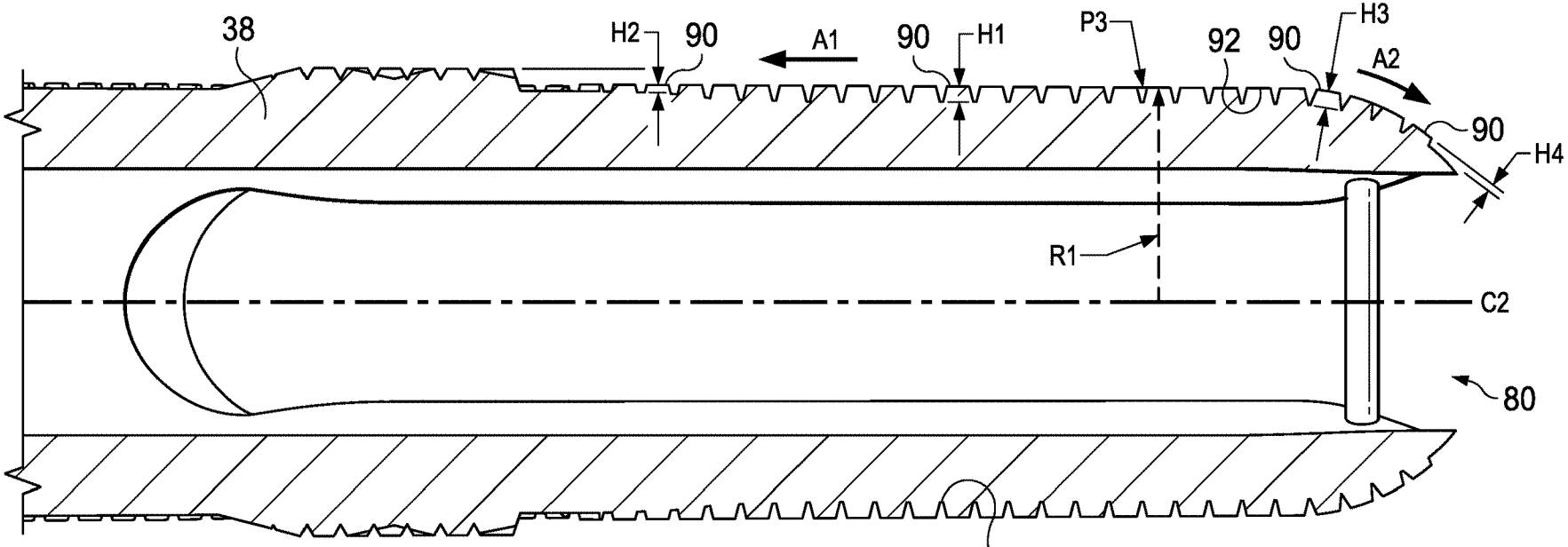
FIG. 12 is a cross sectional view taken along the line 12-12 of FIG. 2.

Referring now to FIG. 12, the cover layer 38 can include a base surface 88 having a plurality of projections 90 extending therefrom. Each of the plurality of projections 90 can have an upper surface 92 that is substantially planar. In one embodiment, the projections 90 are shown to be substantially frusto-pyramidal shaped (i.e., a pyramidal shape missing its top portion such that the upper surface 92 and the lower surface of the shape are parallel), but in other embodiments, the projections 90 can be any of a variety of suitable alternative shapes with substantially planar upper surfaces. In such an embodiment, the upper surface 92 can reside in an imaginary plane (e.g., P3 in FIGS. 12 and 13) that is substantially perpendicular to a radial line (e.g., R1 in FIGS. 12 and 13) extending from the centerline C2.

The projections 90 can be distributed along the cover layer 38 in a pattern that enhances gripping of the base portion 24 by a user's hand. Each of the projections 90 can define a height relative to the base surface 88. In some embodiments, at certain locations along the cover layer 38, the height of the projections 90 can be different from each immediately adjacent projection 90 to provide a desired gripping contour/profile at that location. Referring now to FIG. 12, a plurality of projections 90 is shown that are distributed longitudinally along the cover layer 38 (e.g., intersected by an imaginary plane in which the centerline C2 resides). One of the projections 90 is shown to have a height H1 that is greater than another projection 90 having a height H2. The respective heights of the projections 90 that are interposed therebetween can gradually diminish in the direction of arrow A1, such that the gripping contour defined by those projections 90 tapers in the direction of arrow A1. Another of the projections 90 is shown have a height H3 that is greater than another projection 90 having a height H4. The respective heights of the projections 90 that are interposed therebetween can gradually diminish in the direction of arrow A2, such that the gripping contour defined by those projections 90 tapers in the direction of arrow A2 (e.g., towards the rear end 44 of the body 40).

Referring now to FIG. 13, a plurality of projections 90 is shown that are distributed radially along the cover layer 38 (e.g., intersected by an imaginary plane that is perpendicular to the centerline C2, such as, for example, imaginary plane P2). One of the projections 90 is shown to have a height H5 that is greater than other projections 90 having respective heights of H6 and H7. The respective heights of the projections 90 that are interposed between the projection 90 having the height H5 and the projections having the heights H6 and H7 can gradually diminish in the direction of arrows A3 and A4, such that the gripping contour defined by those projections 90 tapers in the direction of the arrows A3 and A4 towards a top of the body 40 such that the cover layer 38 feels thicker along the bottom of the body 40. It is to be appreciated that the projections 90 can be configured to achieve any of a variety of different contours along the cover layer 38.

Still referring to FIG. 13, in one embodiment, the cover layer 38 can be oval-shaped. For example, the cover layer 38 can have a maximum height H8 measured along the imaginary plane P1 and a maximum width W1 measured along the imaginary plane P2. The ratio of the maximum height H8 to the maximum width W1 can be a ratio of less than 2, preferably a ratio between 2 and 1, and most preferably a ratio of about 15 to about 13.5, respectively (e.g., or a ratio of about 1.11). In some embodiments, the body 40 can additionally or alternatively be oval-shaped. For example, as illustrated in FIG. 13, the body 40 can have a maximum height H9 measured along the imaginary plane P1 and a maximum width W2 measured along the imaginary plane P2. The ratio of the maximum height H9 to the maximum width W2 can be less than about 2, and preferably about 2 to about 1, and most preferably a ratio of about 15 to about 13.5, respectively (e.g., or a ratio of about 1.11). It is to be appreciated that the maximum height and width of the cover layer and/or the body can be measured along any of a variety of locations around the base portion 24 such that the ovular shape of the cover layer and/or body can be any particular orientation.

Figure 14:
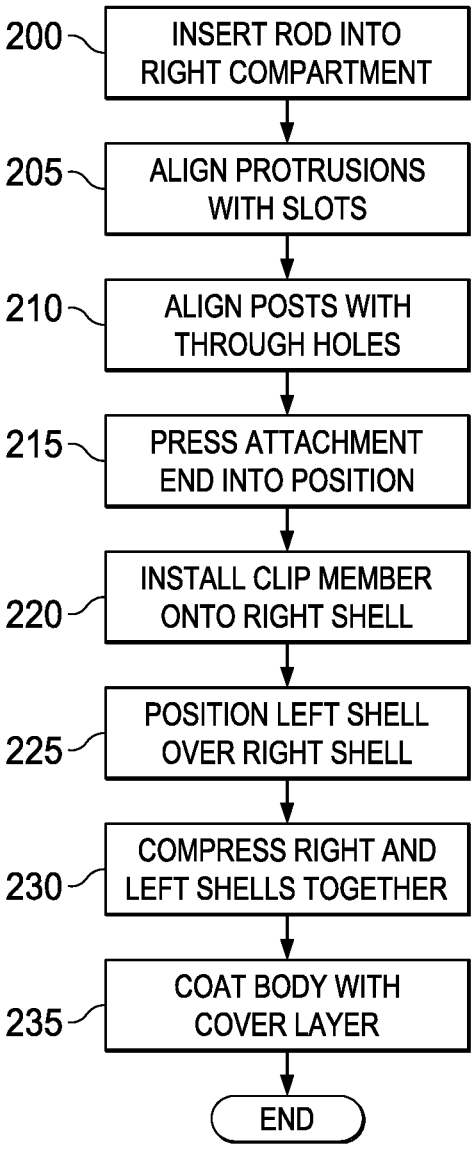
FIG. 14 is a flow chart depicting one example of a method of manufacturing the handle of FIG. 1.

One example of a method for assembling the handle 20 is illustrated in FIG. 14 and will now be described. First, the rod 34 can be installed in the right shell 30 by inserting the rod 34 into the right compartment 66 (200). Next, the attachment end 50 of the head 22 can be installed in the right shell 30 by aligning the protrusions 60 and the posts 62 with the slots 52 and the through holes 56, respectively, of the right shell 30 (205, 210) and pressing the attachment end 50 into position (215). The clip member 36 can then be installed onto the right shell 30 (210) by compressing the clip member 36 such that the recesses 79 and 81 on the clip member 36 engage the projections 83 and 84, respectively, on the right shell 30 to couple the clip member 36 to the right shell 30. The left shell 32 can then be positioned over the right shell 30 (225) such that the protrusions 60 and the posts 62 align with the slots 54 and the through holes 58, respectively, of the left shell 32. The right and left shells 30, 32 can then be compressed together (e.g., manually or via automation)

(230) which can cause the recesses 79 and 81 on the clip member 36 to engage the projections 83 and 84, respectively, on the left shell 32 and can cause the enlarged portions 64 of the posts 62 to extend through the through holes 56, 58 of the first shell 30 and the second shell 32, respectively. The body 40 can then be coated with the cover layer 38 (235). The coating may be an overmolded, or otherwise applied, to the body 40 in such a manner that the cover layer 38 is formed to the body 40. The cover layer may be formed with protrusions.

Examples/Combinations

A. A handle for a razor cartridge, the handle comprising:

a head having a cartridge engaging end and an attachment end;

a body having a front end and a rear end and comprising a first shell and a second shell that are releasably coupled together, wherein the front end is coupled with the attachment end;

a cover layer at least partially surrounding the body; and a clip member coupled with the first shell and the second shell at the rear end of the body such that the first and second shells are held together at least partially by the clip member.

B. The handle according to Paragraph A, wherein:

the clip member has a plurality of first retention features;

the body has a plurality of second retention features; and each of the first retention features interacts with one of the second retention features to facilitate coupling of the clip member to the rear end of the body such that the first and second shells are held together at least partially by the clip member.

C. The handle according to Paragraph B, wherein the first retention features are recesses and the second retention features are projections.

D. The handle according to any of Paragraphs C and D, wherein:

the first and second shells cooperate to define a channel at the rear end of the body; and the clip member is disposed in the channel.

E. The handle according to Paragraph D, wherein the cover layer extends up to but not into the channel.

F. The handle according to any of Paragraphs D and E, wherein the channel and the clip member are substantially U-shaped.

G. The handle according to any of Paragraphs A-F, wherein the clip member has a pair of arm members that are each substantially the same length.

H. The handle according to any of Paragraphs A-G, wherein:

the first shell and the second shell each define one or more through holes; and the cover layer extends into each of the through holes.

I. The handle according to Paragraph H, wherein the through holes are disposed at the rear end of the body.

J. The handle according to any of Paragraphs A-I, wherein the clip member is substantially U-shaped.

K. The handle according to any of Paragraphs A-J, wherein the clip member has a pair of arm members that are each substantially the same length.

L. The handle according to any of Paragraphs A-K further comprising a rod, wherein:

the first shell and the second shell cooperate to define a hollow interior; and the rod is disposed in the hollow interior.

M. The handle according to Paragraph L, wherein the rod comprises one or more of steel, stainless steel and aluminum.

N. The handle according to any of Paragraphs A-M, wherein:

the first and second shells are formed of a first material;

the cover layer is formed of a second material; and the first material and the second material are different.

O. The handle according to Paragraph N, wherein the second material comprises thermoplastic elastomer.

P. The handle according to any of Paragraphs N and O, wherein the second material has a durometer value of between about 15 and about 20.

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

All parts, ratios, and percentages herein, in the Specification, Examples, and Claims, are by weight and all numerical limits are used with the normal degree of accuracy afforded by the art, unless otherwise specified.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the DETAILED DESCRIPTION are, in the relevant part, incorporated herein by reference; the citation of any document is not to be construed as an admission that it is prior art with respect to the present disclosure. To the extent that any meaning or definition of a term or in this written document conflicts with any meaning or definition in a document incorporated by reference, the meaning or definition assigned to the term in this written document shall govern. Except as otherwise noted, the articles "a," "an," and "the" mean "one or more."

The foregoing description of embodiments and examples of the disclosure has been presented for purposes of illustration and description. It is not intended to be exhaustive or to limit the disclosure to the forms described. Numerous modifications are possible in light of the above teachings. Some of those modifications have been discussed and others will be understood by those skilled in the art. The embodiments were chosen and described in order to best illustrate the principles of the disclosure and various embodiments as are suited to the particular use contemplated. In some embodiments, the drawings can be understood to be drawn to scale. The scope of the disclosure is, of course, not limited to the examples or embodiments set forth herein, but can be employed in any number of applications and equivalent devices by those of ordinary skill in the art. Rather it is hereby intended the scope of the disclosure be defined by the claims appended hereto. Also, for any methods claimed and/or described, regardless of whether the method is described in conjunction with a flow diagram, it should be understood that unless otherwise specified or required by context, any explicit or implicit ordering of steps performed in the execution of a method does not imply that those steps must be performed in the order presented and may be performed in a different order or in parallel.

What is claimed is:

1. A razor handle for a razor cartridge, the handle comprising:

a head having a cartridge engaging end and an attachment end;

a body having a front end and a rear end and comprising a first shell and a second shell that are releasably coupled together, wherein the front end is coupled with the attachment end;

a cover layer at least partially surrounding the body; and a clip member coupled with the first shell and the second shell at the rear end of the body such that the first and second shells are held together at least partially by the clip member.

2. The handle of claim 1, wherein:

the clip member has a plurality of first retention features;

the body has a plurality of second retention features; and each of the first retention features interacts with one of the second retention features to facilitate coupling of the clip member to the rear end of the body such that the first and second shells are held together at least partially by the clip member.

3. The handle of claim 2, wherein the first retention features are recesses and the second retention features are projections.

4. The handle of claim 2, wherein:

the first and second shells cooperate to define a channel at the rear end of the body; and the clip member is disposed in the channel.

5. The handle of claim 4, wherein the cover layer extends up to but not into the channel.

6. The handle of claim 5, wherein the channel and the clip member are substantially U-shaped.

7. The handle of claim 6, wherein the clip member has a pair of arm members that are each substantially the same length.

8. The handle of claim 1, wherein:

the first shell and the second shell each define one or more through holes; and the cover layer extends into each of the through holes.

9. The handle of claim 8, wherein the through holes are disposed at the rear end of the body.

10. The handle of claim 1, wherein the clip member is substantially U-shaped.

11. The handle of claim 10, wherein the clip member has a pair of arm members that are each substantially the same length.

12. The handle of claim 1 further comprising a rod, wherein:

the first shell and the second shell cooperate to define a hollow interior; and the rod is disposed in the hollow interior.

13. The handle of claim 12, wherein the rod comprises one or more of steel, stainless steel and aluminum.

14. The handle of claim 1, wherein:

the first and second shells are formed of a first material;

the cover layer is formed of a second material; and the first material and the second material are different.

15. The handle of claim 14, wherein the second material comprises thermoplastic elastomer.

16. The handle of claim 15, wherein the second material has a durometer value of between about 15 and about 20.

* * * * *